US010311839B1

(12) United States Patent
Soberg

(10) Patent No.: US 10,311,839 B1
(45) Date of Patent: Jun. 4, 2019

(54) HALF-DEMON GUITARS

(71) Applicant: Joshua Perin Soberg, Stuart, FL (US)

(72) Inventor: Joshua Perin Soberg, Stuart, FL (US)

(73) Assignee: Joshua Perin Soberg, Stuart, FL (US)

( * ) Notice: Subject to any disclaimer, the term of this patent is extended or adjusted under 35 U.S.C. 154(b) by 0 days.

(21) Appl. No.: 15/844,592

(22) Filed: Dec. 17, 2017

(51) Int. Cl.
*G10D 3/06* (2006.01)

(52) U.S. Cl.
CPC ..... *G10D 3/06* (2013.01)

(58) Field of Classification Search
CPC ..... G10D 3/06
USPC ..... 84/314 R
See application file for complete search history.

(56) References Cited

U.S. PATENT DOCUMENTS 3,159,072 A * 12/1964 Lloyd-Hughes ..... G10D 3/06 84/293
3,392,618 A * 7/1968 Pelensky ..... G10D 1/08 84/267
3,481,238 A * 12/1969 Veres ..... G10D 3/06 84/267
3,564,964 A * 2/1971 Veres ..... G10D 3/06 84/291
3,787,600 A * 1/1974 Muncy ..... G10D 3/06 84/314 R
4,037,510 A * 7/1977 Ginex ..... G10D 3/00 451/28
4,079,652 A * 3/1978 Gittler ..... G10D 3/06 84/205
4,171,661 A * 10/1979 Rose ..... G10D 3/146 84/297 R
4,237,765 A * 12/1980 Valdez ..... G10D 1/08 84/293
4,798,119 A * 1/1989 Leifheit ..... G10D 3/04 84/312 R
4,981,064 A * 1/1991 Vogt ..... G10D 3/06 84/314 R
4,987,816 A * 1/1991 Poor ..... G10D 3/06 84/314 R
5,052,269 A * 10/1991 Young, Jr. ..... G10D 1/085 84/291
5,325,757 A * 7/1994 Ghenea ..... G10D 3/06 84/314 R
5,421,233 A * 6/1995 Bunker ..... G10D 3/06 84/293

(Continued)

*Primary Examiner* — Elvin G Enad
*Assistant Examiner* — Christina M Schreiber

(57) ABSTRACT

In effect, the Sculptured Neck Guitar comprises of purposefully structured fret shapes depicting a three-dimensional pyramid or top half of a circle into the entire guitar neck; face, sides, and the back uniformly. This structure of frets allows drastically improved string bending and also affords multiple variations of string and fret contact points to achieve multiple pitches sounded from one originating fret. Each fret position is enabled to produce a myriad of pitches opening multiple dimensions of pitch options on any or every fret. These structural modifications alone enable the musician a myriad of mobility and multiple new playing techniques adding new sound options within every fret when played while also maintaining the standard functionality and traditional sounds the guitar offers. To simplify, the invention affords a musician the ability to produce multiple notes with one finger on one fret by dramatically bending one string.

1 Claim, 9 Drawing Sheets

(56) References Cited

U.S. PATENT DOCUMENTS 5,537,906 A * 7/1996 Steinberger ..... G10D 1/00 84/291
5,631,432 A * 5/1997 Muncy ..... G10D 3/06 84/293
5,696,337 A * 12/1997 Hall ..... G10D 3/06 84/298
5,756,914 A * 5/1998 Streibl ..... G09B 15/06 84/293
6,034,308 A * 3/2000 Little ..... G10D 1/085 84/267
6,069,306 A * 5/2000 Isvan ..... G10D 1/085 84/267
6,191,350 B1 * 2/2001 Okulov ..... G10H 1/0008 84/646
6,376,756 B1 * 4/2002 Beckmeier ..... G10D 3/06 84/293
6,512,168 B2 * 1/2003 Cortes ..... G10D 3/06 84/290
6,613,969 B1 * 9/2003 Petillo ..... G10D 3/06 84/314 R
6,787,688 B2 * 9/2004 Harmos ..... G10D 1/00 84/267
7,285,708 B1 * 10/2007 Beckmeier ..... G10D 3/06 84/314 R
7,461,424 B2 12/2008 Lindell
7,579,534 B1 * 8/2009 Ryan ..... G10D 3/02 84/267
7,659,464 B1 * 2/2010 Kokodis ..... G10D 3/06 84/293
7,763,786 B2 * 7/2010 Jones ..... G10D 3/06 84/314 R
8,324,489 B1 * 12/2012 Chapman ..... G10D 3/06 84/314 R
9,082,385 B2 * 7/2015 Rubman ..... G10H 3/181
9,147,381 B2 * 9/2015 Dlugasz ..... G10D 3/06
9,478,198 B1 * 10/2016 Daley ..... G10D 1/085
9,520,109 B1 * 12/2016 Edwards ..... G10D 1/08
9,881,593 B2 * 1/2018 Edwards ..... G10D 3/06
2001/0029827 A1 * 10/2001 Chapman ..... G10D 3/06 84/314 R
2002/0112592 A1 * 8/2002 Gillis ..... G10D 3/043 84/318
2004/0173080 A1 * 9/2004 Pye ..... G10D 3/06 84/314 R
2005/0081698 A1 * 4/2005 Tarpinian ..... G10D 1/00 84/291
2007/0163420 A1 * 7/2007 Reiss ..... G10D 1/085 84/329
2012/0137859 A1 * 6/2012 Degerland ..... G10H 1/342 84/731
2012/0266734 A1 * 10/2012 Kunstadt ..... G10D 3/06 84/293
2013/0247744 A1 * 9/2013 Helgesson ..... G10H 1/0016 84/314 R
2013/0255465 A1 * 10/2013 Wilson ..... G10D 3/06 84/291
2014/0318345 A1 * 10/2014 Fraser ..... G10G 1/02 84/314 R
2015/0082966 A1 * 3/2015 Compani-Tabrizi ..... G10D 3/06 84/314 R
2016/0027422 A1 * 1/2016 Baker ..... G10H 3/22 84/726
2018/0158439 A1 * 6/2018 Quercetani ..... G10D 3/02

* cited by examiner

HALF-DEMON GUITARS

FIELD AND APPLICABILITY OF THE INVENTION

The following invention pertains directly to modifications made to the neck of a traditional guitar. The Sculptured Neck Guitar's neck is skillfully shaped to modify each of the frets on the guitar neck.

BACKGROUND OF THE INVENTION

The traditional neck of a guitar has frets on the face below the guitar strings enabling the musician to control the notes played by pressing the guitar strings down on the chosen fret or frets issuing the desired individual note or pitch sounded with every different fret and string combination on the neck of a traditional guitar.

Formerly the traditional guitar neck is a delicately fashioned design made standard enabling the musician to recognize the same notes or pitches to create songs on every standard guitar. The frets cascade in size and shape while moving down the neck in a unified manor while the lengths of each fret are gradually made smaller to capture standard notes or pitches perfectly from one fret bar to the next. When pressing a string on any chosen fret of the neck on a guitar, the distance of the string length issues accurate notes or pitches for every fret on the guitar neck when played by a musician.

The traditional guitar neck is constructed from wood in two basic layers. The face of the guitar neck is the fretboard made from a thin layer of higher quality wood such as maple or rosewood. The actual guitar neck is constructed with a less dense wood to exact dimension and shaped together with the fretboard on the face and with exact length width and shape standard shaping to create accurate notes and pitches.

The fret bars are steel dividers dividing each fret horizontally where by the musician firmly places a finger on a fret in front of the fret bar, the string length is held on the fret bar to produce a standard note or pitch distinctly unique to all other fret and string combinations.

On Oct. 23, 1979 Floyd Rose was granted patent for his Guitar tremolo method and apparatus invention U.S. Pat. No. 4,171,661A two days after my fourth birthday. The invention historically impacted lead guitar and guitar solos to this day and forward. With the use of the Floyd Rose tremolo and "whammy bar" system, musicians are able to create a diverse array of pitches from applying pressure to the "whammy bar" and movable tremolo system bending the strings directly from the bottom string contact point, or the bridge dramatically impacting the pitches sounded.

My invention is similar allowing for extreme bending of guitar strings for drastic pitch options deriving from the neck and fret contact point of the guitar strings. Where my invention differs is the shaping of individual frets allows the musician to make drastic string bends producing multiple pitches from any contact of strings made directly from the neck of the guitar, and not from the bridge and tremolo system. The Floyd Rose tremolo enhances extreme string bending and multiple pitch options at the bridge where my invention enhances major string bending and pitch options from any point of the neck of a guitar.

Poor invented an attachable raised fretboard for a fretless guitar to provide easier fingering, a clear sound, and to reduce wear on the fretboard. The Fingerboard invention U.S. Pat. No. 4,987,816A has raised edges and recesses from fret blocks placed on a fretboard. My invention differs as my recesses are vividly shaped into the fretboard itself and sculpted into shapes deliberately to produce deep string bends for aggressive pitch change options.

In 1978 Allen Gittler was patented U.S. Pat. No. 4,079,652A for a very unique guitar design which was made of all steel consisting of a steel bar as a guitar neck and only slotted steel frets protruding up from the steel rod neck. Gittler's invention is similar to mine as negative space is obviously used within the design. Where our inventions part ways are that my invention is made of sculpted wood. The pitch changes made on my invention are also made by pulling a string on the side and even behind the neck due to the unique shaping of frets. Each unique invention could not be played in the same way nor could the same sounds possibly be created as these are both unique and different stringed instruments all together. Gittler's frets are rectangular steel bars welded to a steel bar neck. My frets are sculpted into the wooden neck of a guitar with fret shapes appearing like a half circle or pyramid like shaping to the artist's rendering.

Rubman U.S. Pat. No. 9,082,385B2 invented a very similar metal instrument to that of Gittler's design but with metal pickups connected to the steel rods and lights on each fret with negative spacing yet an altogether different playing instrument than a sculpted neck guitar. It would be impossible to pull the strings on the sides of the latter two inventions to arrive at a different pitch with the string making critical contact with a lower fret deriving from a horizontal pull from the originating fret as achieved through my design.

Valdez U.S. Pat. No. 4,237,765A designed a guitar neck creating notches on the top of the neck for thumb guides. While this design has shaping into the neck of the guitar, the shaping serves to guide a musician's thumb placement. The shaping mentioned does not reach into the face of the guitar nor does it affect the sounds made from the guitar as does a Sculpted Neck Guitar.

Wilson in US 2013/0255465 manipulated the traditional neck achieving a design that conforms to a musician's hand while playing. This design cuts into the neck for a more comfortable shape to the hand for playing. Again, his shaping does not coexist into the face of the fret board itself and also does not affect the sounds or pitches produced from my design where the individual frets are specifically designed both into the fret board face and likewise around the neck dramatically affecting the pitches one can create with each new sculptured fret.

Pye with US 2004/0173080 changed the pitches with his design through moving the steel frets on the face of the guitar neck diagonally as opposed to horizontal frets. His unique design certainly manipulates the sounds made and offers a new playing style. The sculptured neck guitar design actually adds multiple dimensions of pitches offered from each cut and shaped fret and is designed to be played with the new ability to pull and bend the strings on the sides of the neck nearly to the back creating a new dimension of pitches for some intense solo art work by the musician.

Michael Lindell U.S. Pat. No. 7,461,424B2 must have done some camping in northern Minnesota in order to mastermind his invention, My Pillow. My father brought me camping in northern Minnesota as a child portaging canoes mile into a very beautiful area bordering Canada where you could drink pure water strait from the lake without any worry. My father among many insisted that a small layer of foam underneath a sleeping bag or his head achieved optimum comfort on the trail. Mr. Lindell took this concept further by adding small pieces of foam to the center of his pillow. He then ran an advertising campaign so redundantly saturating the minds of the American people that many are now proud owners of My Pillow. You cannot find a TV or computer made in America but you sure can find a pillow made in the USA today. Everything, even electronics were made in the USA in my late grandfather's time of WW2 as I have antiques to prove this from this decorated Navy Lieutenant and true gentleman exuding whit, humor, charm and class unmatched as I have not once in my life met his equal.

All of the ideas and inventions mentioned are a concupiscence of real American ingenuity and follow the true entrepreneurial spirit of the founders of our great country who backed by faith and will to beat all odds through uncompromising vision of freedom and liberty conceived this American dream. It is well known that you will assuredly not get a good night of rest backing your head on a Sculptured Neck Guitar like you absolutely will, and even may have resoundingly better dreams in slumber on Lindell's invention. Both inventions were born in America under the unequivocal pursuit to improve life lived in some fashion.

DISCOVERY OF THE INVENTION

The passion of designing hand crafted wood work by sculpting astatically desirable beauty from a traditional guitar and manipulating the form to the desired end has always superseded my desire to practice and play a traditional guitar as a musician. Through this laborious, time consuming, and very delicate work on several traditional guitars through the years, I arrived at a new discovery that inevitably altered the shape of a traditional guitar neck. This ultimately creates a new dimension to the sounds produced by a musician playing Sculptured Neck Guitars as opposed to a limited traditional guitar.

My intent originally was to create a more aggressive and astatically looking appearance to the guitar neck. I only fully discovered the manifestation of this new creation when the strings were placed on the finished guitar and I plugged it into an amplifier and played my invention, the first Sculptured Neck Guitar.

Having scoured every guitar company I could research seeking a partnership, and thousands of guitar images and designs through the years, I have not found one guitar designed like my invention. My work through the years has been private and the only people I have shared my inventions with are close friends and family with the exception of B. C. Rich Guitars. Once I received verification of my patent pending status owner Brian Martin was kind enough to refer me to designer/luthier Neal Moser, a legendary inventor of many famous B. C. Rich Guitar designs since the 1960s. Having shared all of my design work with Mr. Moser, he was astounded and explained that in his entire career, he has never encountered anything even close to my inventions and unique design work. I was then reassured that I am the sole originator and the first and only inventor of Sculptured Neck Guitars.

INVENTION DESCRIPTION

The Sculptured Neck Guitar neck specifically distinguishes the function ability of the musician's sound options as opposed to the limited and standard note, pitch, and sound options previously available to a traditional guitar neck FIG. 1.

The neck and frets are individually cut so that each fret is shaped from the bottom of the fret bar being the widest area and moving the cut vertically and diagonally inward adding negative space to the top of the next horizontally standard fret bar FIG. 2.

The cuts into the necks extend horizontally encircling the entire neck at every fret with a line of negative space as a guideline to the whole hand of the musician accentuating every fret on the neck of the guitar FIG. 3. This allows the musician another depth from the feel of the frets marked around the neck and not just on top of the fretboard like a traditional guitar neck.

DETAILED DESCRIPTION OF THE INVENTION

Figure 1:
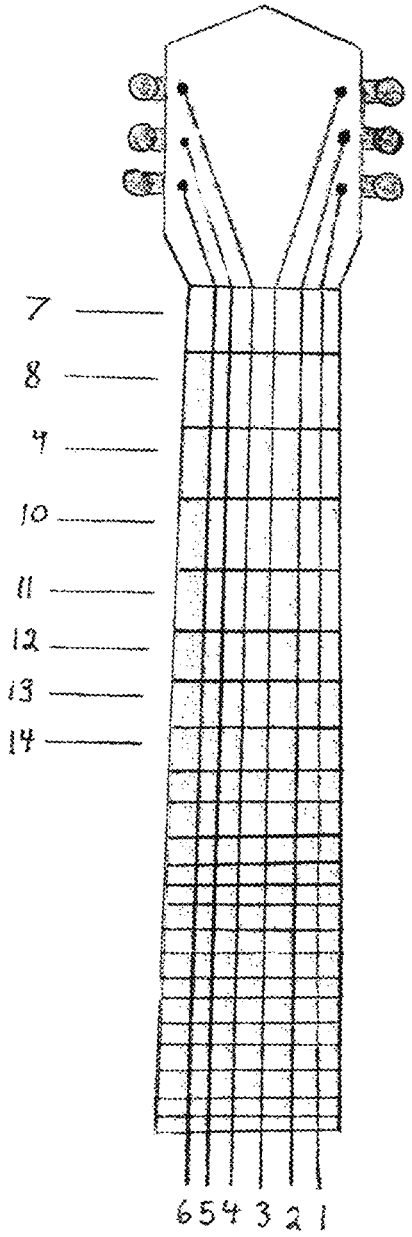
FIG. 1 depicts a traditional guitar neck including standard strings and frets to give the reader a clear understanding of the following invention.

FIG. 1 characterizes a traditional guitar neck complete with strings 1-6 and frets starting with the first fret, the standard F note, through the seventh fret, a standard C note 7-14 as a preamble to distinctly clarify the differences in the following invention later in FIG. 7.

Figure 2:
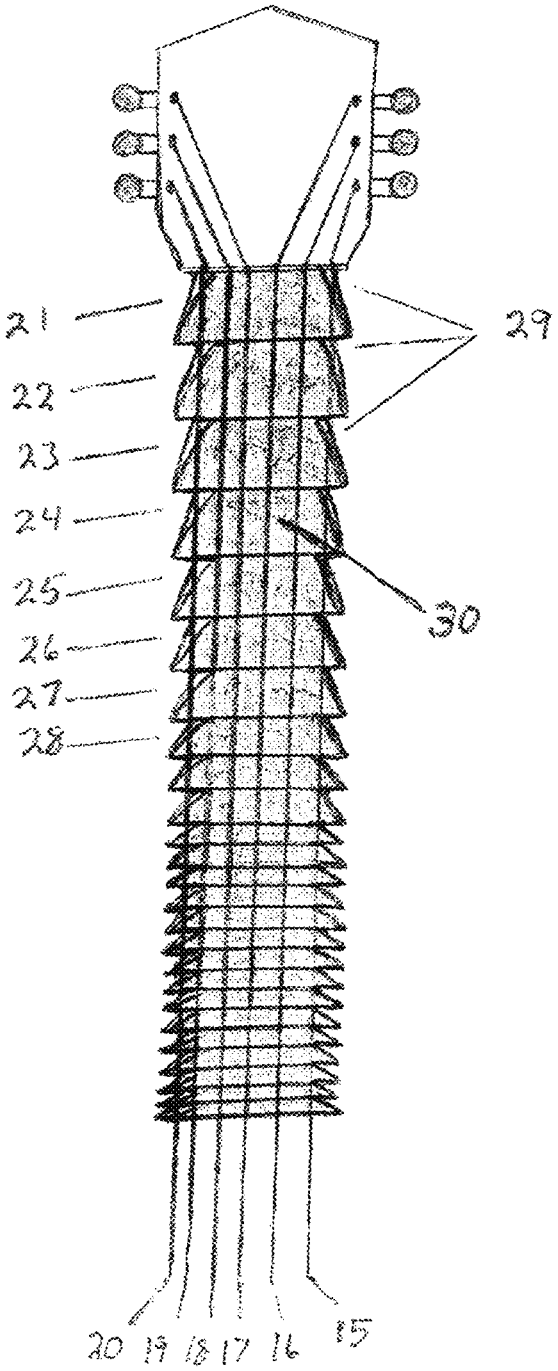
FIG. 2 portrays a frontal vantage of a modified guitar neck introducing now sculptured negative space and empty space to a traditional guitar neck.

FIG. 2 exemplifies the embodiment of the invention from a frontal view similar to a traditional guitar neck yet distinctly different in shape and in style. In effect this planned and sculpted addition of negative space to the traditional fretboard and shaped into the entire neck of the guitar now affords the musician a much broader range of sound from each fret of the guitar neck itself. Designer options of this example derive from both negative space in the wood subtracted and additionally the part that is now empty space which used to be the wood in the traditional guitar neck.

FIG. 2 also includes the standard six strings 15-20 and the standard frets 21-28. Negative space designed both into the existing fretboard, and also skillfully cut to add empty space, is pointed out in 29. The positive space or wooden fret on the neck of the guitar is shown in 30 pointing to the face of the fretboard. Together these create a unique design to the concept at large directly resulting in a now broader range of sound where the magic is made by the musician's fingers while playing. At the same time, the design allows the musician to play standard notation traditionally as well with no obstructions.

Figure 3:
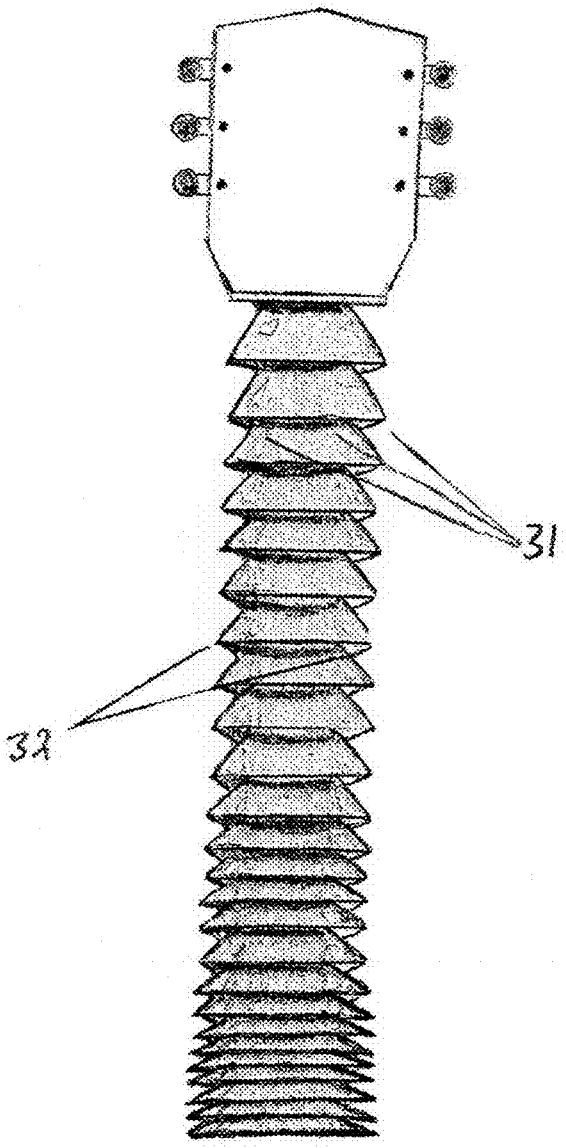
FIG. 3 portrays the back-perspective view of the modified guitar neck exemplifying the negative spacing while demonstrating how shaping the half circle around the back of each fret leads to a fuller hand recognition felt by the musician of the improved guitar neck design.

FIG. 3 portrays an aggressive new shaping to the entire neck detailing every fret from a full back view. The negative space 31 encircles the entire neck of the guitar horizontally fret by fret creating an improved feel where each fret is now felt on the back of the neck as opposed to the traditional model where the fretboard markers are the only mark felt by the musician's fingers. Together with the positive space or the wood being shaped thicker encircling each fret on the fret bar 32 now only offers added movement afforded to the musician to play a broader range of notes from any chosen fret which is clearly limited on that of a traditional guitar neck.

Figure 4:
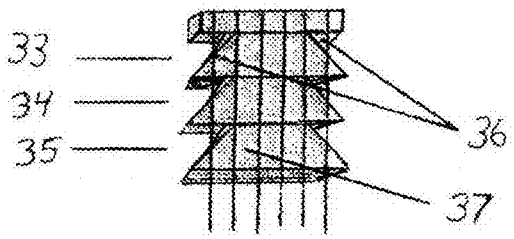
FIG. 4 exemplifies a close-up take of a modified guitar neck design on the top three frets to offer the musician a specific sound formula when playing.

One design example of this invention shown in FIG. 4 gives a close-up image of the top three frets 33-35 with a specifically shaped area 36 shown in white bordering the face of the neck on the guitars 37 shaded area 36, shown in white bordering the face of the neck on the guitar 37 shaded in black. The result is an acutely unique custom instrument affording the musician with a broader range of sound everywhere on the neck and an added dimension of playing techniques that previously did not exist.

Figure 5:
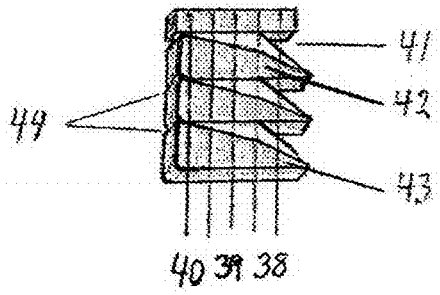
FIG. 5 portrays another unique example of the modified guitar neck resulting in a unique design with a different yet similar sound formula to the former emphasizing the lower string when the musician plays.

FIG. 5 shows a model of the invention dear to me as my first guitar neck sculpture and the cornerstone of my toil that lasted a decade before final completion. This rendition named Liz is dedicated to my Grandmother and is very personal to me.

The right side of the neck is shaved from top to bottom resulting in both a thinner width of the guitar neck for the musician to hold also creating a five-string guitar shown in 38-40; on strings one through five. The negative space 41 compliments the positive space or the fret 42 on the face of the fretboard.

In this model however the fret bars are removed 43 making this a fretless guitar neck. Closer examination to the fretboard face 44 shows dark shading at the bottom of each fret implying thicker wood where the fret bar was and lighter shading going up showing the fret itself being gradually shaped into a thinner neck proceeding upward with the thinnest area bordering the next fret up. This gradual wood cut to the face of the neck only allows a clear sound, pitch, or note issued because the fret bars were removed. In other words, a skillful cut to the fret replaces the fret bar and the design itself now offers elegant mobility to the musician from subtracting the friction of the fret bars as the hand moves up and down the neck of the guitar.

Figure 6:
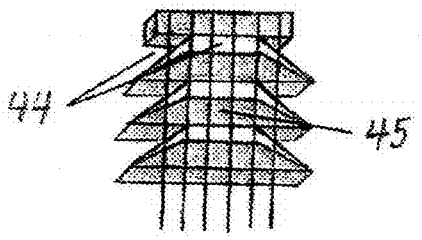
FIG. 6 portrays a unique example of the modified guitar neck adding an emphasis of more negative space resulting in a one of a kind sound formula offered to the musician while playing.

FIG. 6 depicts yet another model within the context of this invention exhibiting negative space 44 shown in white and is cut into the top portion of each individual fret horizontally in order to promote a distinctly unique design. This negative space comprises of both negative shaping of the fret, and empty space. Both impact the sound and both are designed to the artist's rendering within the scope of this concept. The existing wood of the fretboard area 45 is shaded darker for clarity. This design allows for a broader range of sounds, pitches, and notes issued from all six strings when implementing now new techniques in playing the instrument.

Within the above mentioned three examples in FIGS. 4-6, all models uniquely complement the idea that each sculpted design shaped into the fretboard face and the neck of a traditional guitar holds both aesthetic beauty and a new vast arena of styles, sounds, and techniques a musician now has in his or her instrument.

Figure 7:
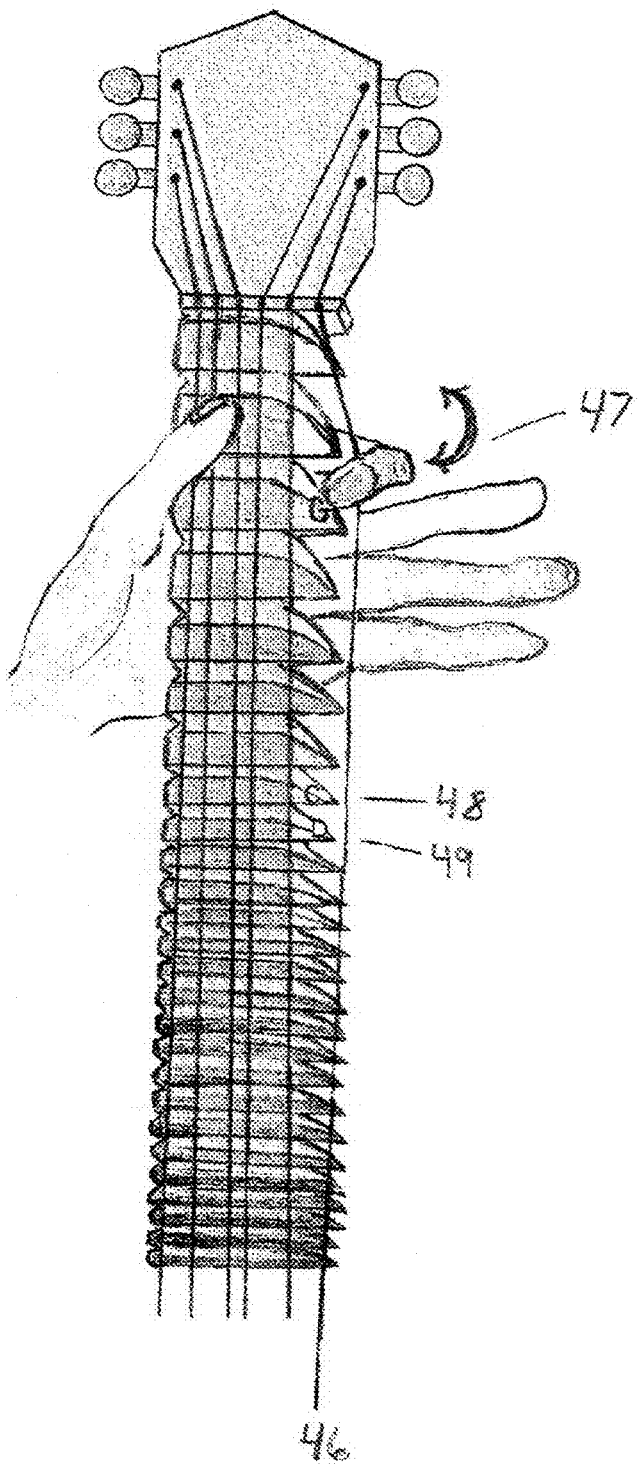
FIG. 7 depicts a frontal perspective action image of a musician's left hand displaying the new and broader range of notes, sounds, or pitches one can now create from one single fret. In this case the musician is firmly holding the first string on the third fret making the sound of the C note on the traditional G fret dictated by how far back on the side of the modified neck the string is now pulled.

FIG. 7 displays a pointer finger pulling the first string 46 on the third fret from the G note position 47 horizontally down the side of the guitar neck ⅛ inch on the right side of the fret into a C note 48 where the string now touches the eighth fret on the fret bar. The same string 46 pulled down another ¼ inch lower on this rendition results in the next fret down the eleventh fret, 49 a D note issued to the musician when applied. Other designs may vary to the rendering of the artist as a mathematical science of music in speed, and in sound. The string of the guitar on my invention physically slides downward to variable lengths and fret spaces to the next note from a horizontal movement.

Comprehension of this concept at large, in the model described brings forward the fact that a musician can now render several notes with one finger from one single fret! Now a musician can play multiple notes with one finger on one fret from the concept. My intent is to pass creativity on for future musicians to enjoy. Non-musicians especially may now easily take on new interest in the guitar naturally and gracefully, a beautiful instrument that may have lost some attention in recent years.

Figure 8:
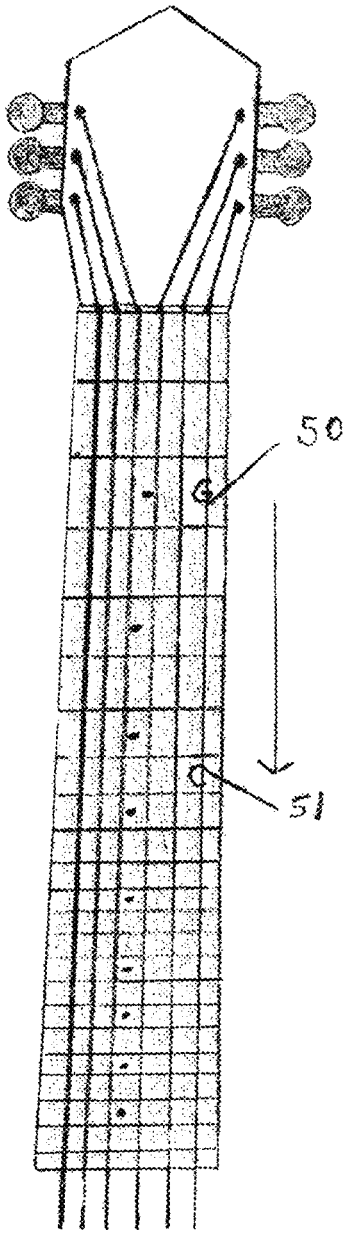
FIG. 8 is a picture of the equivalent distance a musician would need to arrive at traveling from fret 3, the G note five frets down to arrive at the C note.

FIG. 8 depicts the movement a musician must move vertically down the neck of a traditional guitar to replicate FIG. 7. Here the C note on fret eight with the first string moving down 50 from the third fret first string D note 51 details the contrast. This functionally can only be made on a modified guitar neck now opening the door to multiple sounds, techniques, and the pure imagination of a musician practicing on such a design.

Figure 9:
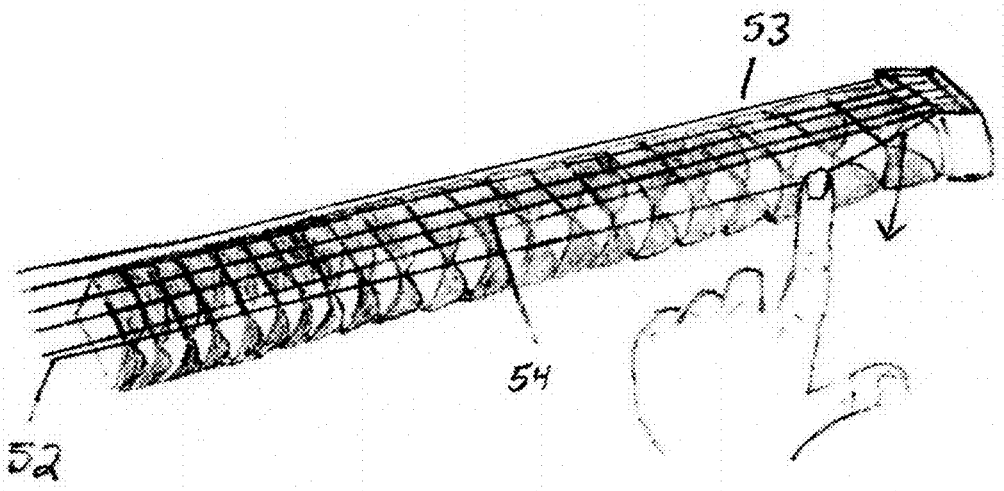
FIG. 9 further illustrates the mechanism applied to the additional sound options availed. Captured here is the length one has to pull the first string third fret down on the side of the neck to touch the string down now on the tenth fret sounding a D note from the G fret with a clear side view.

FIG. 9 shows a side and top perspective of the model to further clarify the points made in FIG. 7, again showing that with a modified neck and frets, now a musician can play several notes from a single fret and only one finger. Here the musician is pulling the first string 52 on the third fret 53 G note only ⅛ inch down the neck from the fret literally now on the side of the guitar neck. The string now sounds off the D note with the string 52 touching on the $10^{th}$ fret 54 from the third fret 53.

Figure 10:
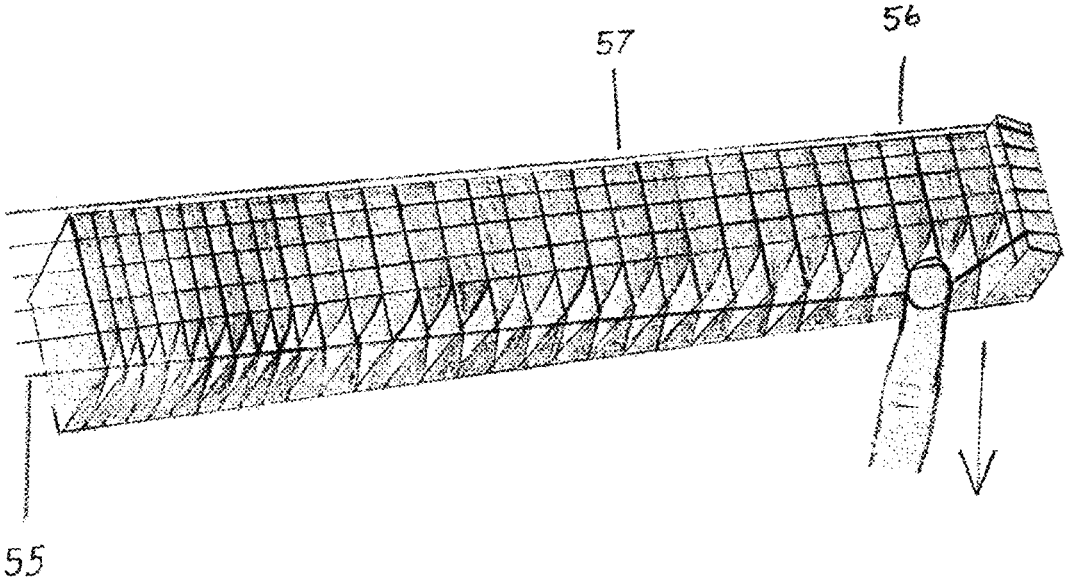
FIG. 10 completes the last illustration showing that pulling the same first string third fret even further down the side of the neck, the first string now touches down of the eleventh fret sounding a D sharp/E flat note from the G fret.

FIG. 10 continues to clarify further that when a musician pulls the first string 55 from the third fret G note 56 at ¼ inch down the neck slightly lower than that of FIG. 9 by another ⅛ inch. This leads to the first string sounding off one fret down from FIG. 9 on the $11^{th}$ fret 57 where it rests on the D sharp/E flat note. From one fret a designer can now fashion a guitar neck enabling a musician to play several notes from one single fret with additional horizontal movements that did not exist prior on a traditional guitar neck. This allows added creativity opening up undiscovered techniques and the advent of speed to a musician's arsenal of talent in sounds played while likewise allowing all traditional notes to be played on each fret of the guitar neck.

Figure 11:
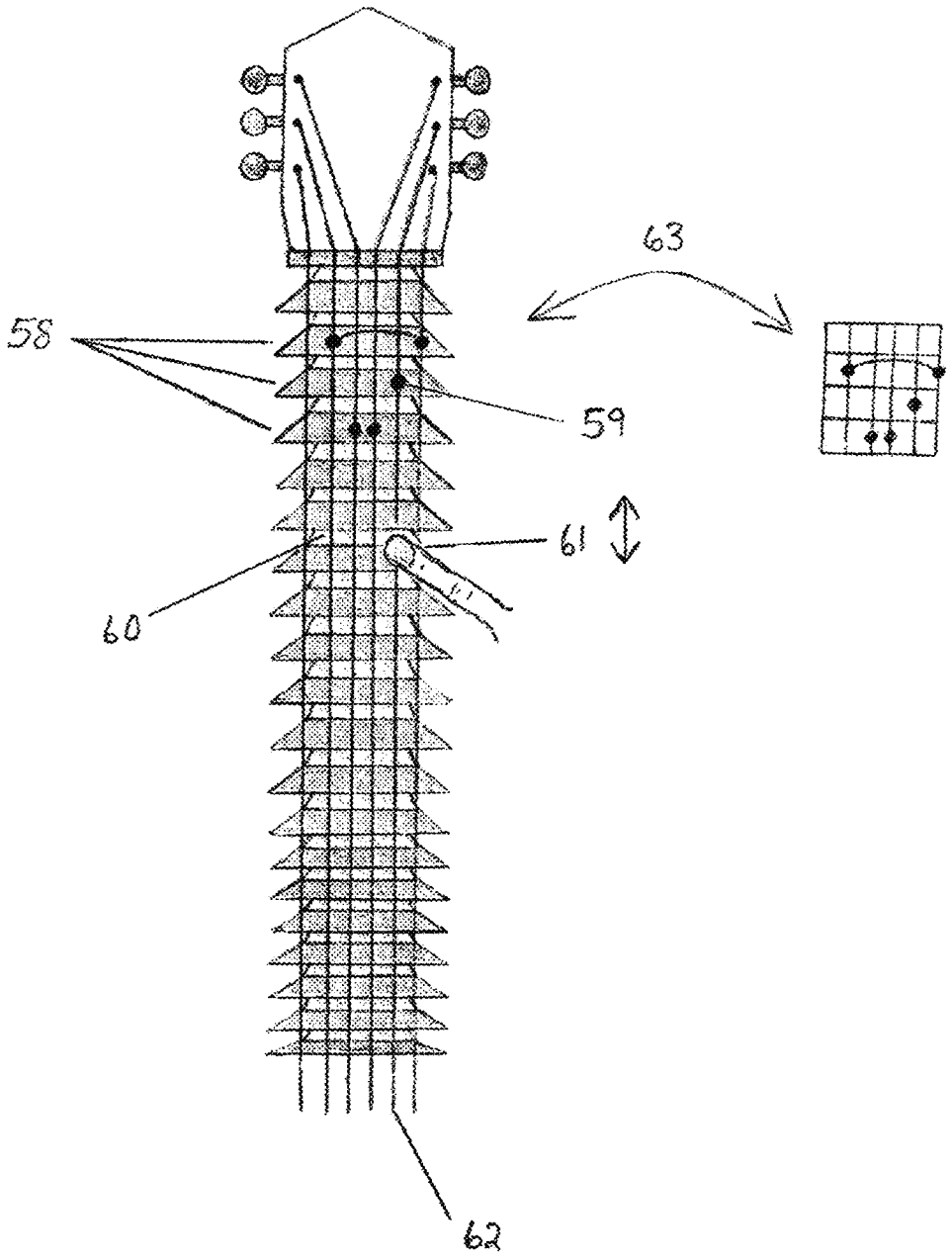
FIG. 11 depicts a more dynamic example of a new technique of playing guitar with the advent of negative space to the top of each individual fret. By pressing firmly down and up on the string variably, this now adds a new dimension of sound options available to the musician than that of a traditional neck using the same finger placement.

FIG. 11 lends a complexity to a very simple and fun discovery found with the advent of a modified neck guitar illustrating two points. The musician's left hand is displaying a bar chord in B minor 58 illustrated in bar chord formation 63 to the right. Point one simply illustrates the fact that a musician is fully capable of playing a traditional guitar melody uninhibited within the context of each design. Please observe that the fingers are holding firmly on the shaded area representing the neck, frets, or positive space making a standard B minor chord. The right-hand pointer finger on the first string 62 is shown pressing up and down movements on the seventh fret F sharp. Closer observation shows the pointer finger pressing the second string 61 on the seventh fret into the white area 60 which is negative space both constructed and designed in the fret itself and through the created empty space. Now the left-hand middle finger is holding the third fret D note 59, where the musician is shown pressing down on the F sharp producing a rapid G note from pushing into the negative space created at the top of each fret. This exemplifies the new range of notes on an individual fret of each string from now pressing hard right into the fretboard itself.

To simplify, this new design offers on every fret the new ability for the musician to press down on any string including chords and spacing choices producing multiple notes within each fret. Because of the new negative space both on the fret and into empty space, coupled with the structure of the fret on each neck lends the ability to move any and all strings on every fret an entire note without moving horizontally or vertically but through pressing down directly into the frets of the guitar neck. This option leads to the ability to bend each string directly into each fret allowing further sound innovation. In contrast, on a traditional guitar pressing down directly into the wood does not change the sound but only ensures the sound of a clear note.

SUMMARY OF THE INVENTION

Thus far a traditional guitar neck has no negative spacing rescinding downward on into the individual frets or empty space encircling each fret and is limited to the standard sounds, notes, or pitches a musician could create when pressing a guitar string on any given fret. Only on a Sculptured Neck Guitar is the neck of the guitar shaped and cut into the actual fretboard and neck together creating a new design and complex shaping to the existing traditional guitar neck itself. This shaping and modification enable the musician a myriad of sounds, pitches, and notes from the same fret adding a powerful dimension to options a musician can now create.

Only through the addition of negative space to each or any specific fret of a guitar can a musician have new options of sound to create on every newly designed guitar fret. The various degrees of cutting negative spaces both into the fretboard and following through the neck of the guitar will ultimately produce the desired shapes creating calculated sounds, notes, and tones the inventor has now afforded the musician right down to a science.

All three examples FIGS. 4-6 of the multiple conceptual options are found in the enclosed sketch exhibits depicting the idea captured. All three unique models compliment the understanding mentioned above clearly and precisely demonstrating the differences of a traditional guitar neck as opposed to the newly created advent of sculpting the traditional neck of a guitar into the fretboard. Cuts designed into the neck from concept to application render this concept to be patented in many unique forms resulting in numerous guitar neck sound and design options that benefit the musician.

The invention claimed is:

1. A stringed instrument neck structure comprising:

a fretboard including individual frets configured as three dimensional structures resembling a modified pyramid or a top half of a circle within a combined fretboard's face, sides, and back of the neck, together in unison;

wherein a horizontal point around the middle of a face of each fret starts the structure of a decline shape cascading down into the fretboard and meeting the next horizontal fret, the thinnest area of each fret being within the said three-dimensional structure;

said structure configured into the fretboard with the bottom of one or both sides of the fret face being the widest part, and then gradually rescinding thinner diagonally and vertically upward to the top of the fret which is the thinnest area of the fret;

said rescinding structure configured uniformly, combining the fret face shape into the side of the bordering neck continuing uniformly inward defining the shape of both the neck and fret with the fret face and side forming together in one flowing three-dimensional shape within each individual fret;

said rescinding structure ascending diagonally or circularly progressing within the fretboard and neck together within each or any chosen fret face depicting a pyramid like shape or a half circle structure;

said fret structure shape continuing circularly, uniformly, and horizontally full circle around the back of the neck of any fret;

said structure configured to increase string bending and achieve additional pitches to be accomplished within any individual fret when played by a musician;

wherein proper fingering space structure at the bottom of each fret face within every fret on the neck is maintained, unscathed, flat, and solid allowing room for a musician's fingers to produce any and all of the standard notes, pitches, or chords traditionally sounded on a stringed instrument.

* * * * *